US010073377B2

(12) United States Patent
Itabashi

(10) Patent No.: US 10,073,377 B2
(45) Date of Patent: Sep. 11, 2018

(54) DEVELOPING CARTRIDGE

(71) Applicant: Brother Kogyo Kabushiki Kaisha, Nagoya-shi, Aichi-ken (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/472,594

(22) Filed: Mar. 29, 2017

(65) Prior Publication Data

US 2017/0285523 A1 Oct. 5, 2017

(30) Foreign Application Priority Data

Mar. 31, 2016 (JP) ..... 2016-070707

(51) Int. Cl.
*G03G 15/08* (2006.01)

(52) U.S. Cl.
CPC ..... *G03G 15/0874* (2013.01); *G03G 15/0889* (2013.01)

(58) Field of Classification Search
CPC ..... G03G 15/0874; G03G 15/0889
See application file for complete search history.

(56) References Cited

U.S. PATENT DOCUMENTS 3,501,065 A * 3/1970 Altmann ..... G03G 15/0884 222/392
3,561,647 A * 2/1971 Altmann ..... G03G 15/0882 222/179.5
4,766,457 A * 8/1988 Barker ..... G03G 15/08 399/106
5,075,727 A * 12/1991 Nakatomi ..... G03G 15/0896 399/103
6,178,302 B1 * 1/2001 Nagashima ..... G03G 15/0896 399/106
9,063,464 B2 6/2015 Furutani et al.
2013/0336679 A1 12/2013 Furutani et al.

FOREIGN PATENT DOCUMENTS

JP 2014-016592 A 1/2014

* cited by examiner

*Primary Examiner* — Francis C Gray
(74) *Attorney, Agent, or Firm* — Banner & Witcoff, Ltd.

(57) ABSTRACT

A developing cartridge includes a developing roller, a developer bag, a housing, and a shaft. The developer bag stores a developer therein. The housing includes a developer storage chamber accommodating the developer bag therein. The housing supports the developing roller. The shaft is fixed to the developer bang and movable pull the developer bag theretoward.

19 Claims, 9 Drawing Sheets

DEVELOPING CARTRIDGE

CROSS-REFERENCE TO RELATED APPLICATION

This application claims priority from Japanese Patent Application No. 2016-070707 filed on Mar. 31, 2016, the content of which is incorporated herein by reference in its entirety.

FIELD OF DISCLOSURE

Aspects disclosed herein relate to a developing cartridge including a developer bag in a housing thereof.

BACKGROUND

A known developing cartridge includes a bag-like developer container (hereinafter, referred to as a "developer bag") within its housing. The developer bag stores a developer therein. The developer bag has an outlet for releasing the developer therethrough. The outlet is closed by a film-like seal member to seal the developer bag. The seal member is fixed to a shaft of an agitator, and is removed or peeled from the developer bag by rotation of the agitator. The removal of the seal member thus allows the developer to flow from the developer bag through the outlet.

SUMMARY

Nevertheless, in the known art, the developer bag that has become empty of the developer may remain inside the developing cartridge. The developer bag remaining inside the developing cartridge may obstruct agitation or supply of the developer.

According to the one or more aspects of the disclosure, a developing cartridge may include a developing roller, a developer bag, a housing, and a shaft. The developer bag may store a developer therein. The housing may include a developer storage chamber accommodating the developer bag therein. The housing may support the developing roller. The shaft may be fixed to the developer bag and movable to pull the developer bag theretoward.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Hereinafter, an illustrative embodiment will be described with reference to the accompanying drawings.

Figure 1:
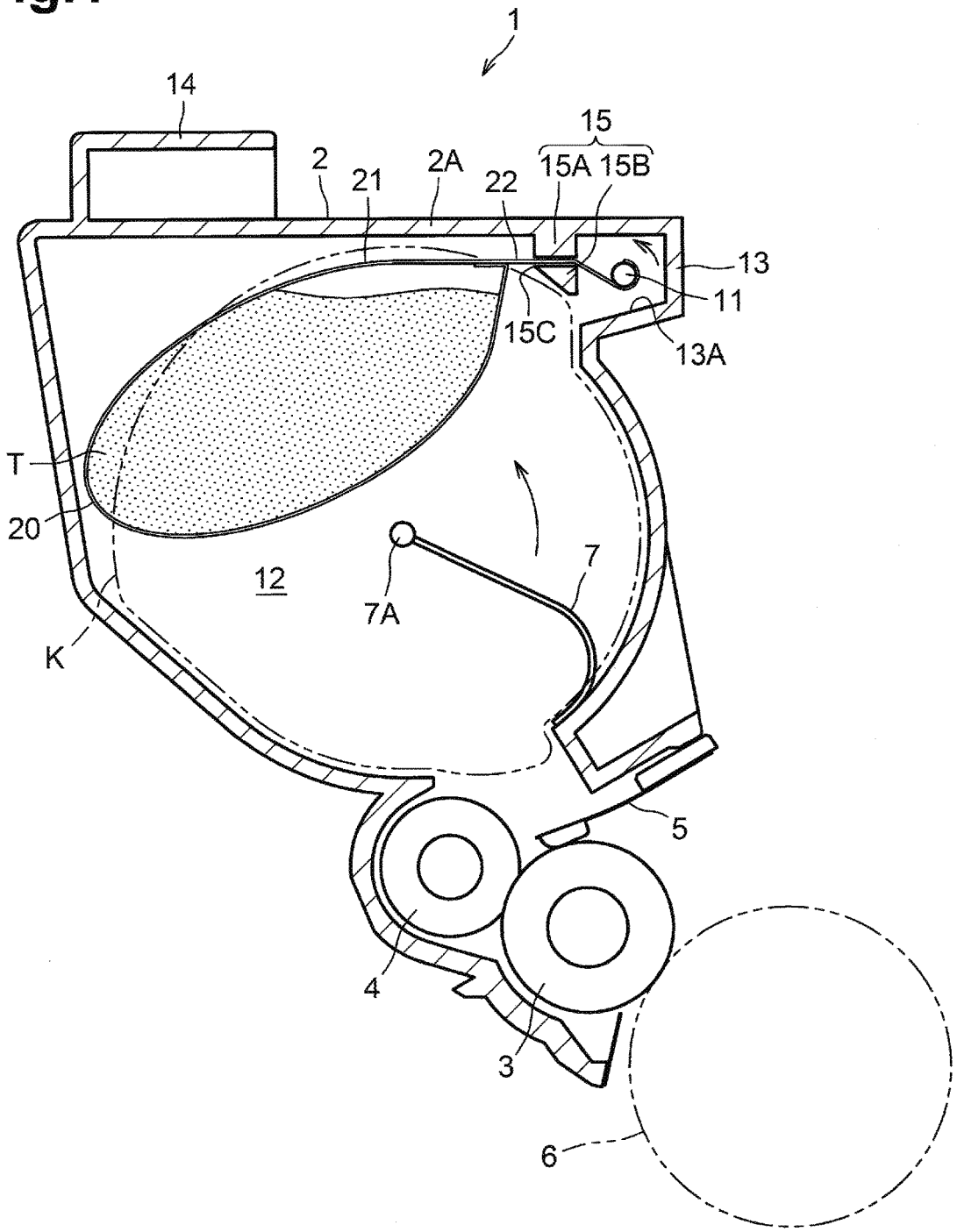
FIG. 1 is a sectional view illustrating a developing cartridge when viewed in a direction in which a rotation axis of an agitator extends in an illustrative embodiment according to one or more aspects of the disclosure.

As illustrated in FIG. 1, a developing cartridge 1 includes a housing 2, a developing roller 3, a supply roller 4, a layer-thickness regulating blade 5, an agitator 7, a developer bag 20, and a winding shaft 11 (as an example of a shaft). The developer bag 20 may store toner T (as an example of a developer) therein. The winding shaft 11 is fixed to the developer bag 20, and movable to pull the developer bag and wind the developer bag therearound.

The developing roller 3 is rotatably supported by the housing 2. The developing roller 3 is disposed in contact with or near to a photosensitive drum 6.

The supply roller 4 is disposed in contact with the developing roller 3. The supply roller 4 is configured to supply a developer to the developing roller 3. The supply roller 4 is rotatably supported by the housing 2.

The layer-thickness regulating blade 5 has one end that is supported by the housing 2, and the other end that is positioned in contact with the developing roller 3.

The developer bag 20 includes a bag portion 21 and a connecting portion 22. The bag portion 21 stores toner T therein. The connecting portion 22 has one end that is connected to the bag portion 21, and the other end that is connected to the winding shaft 11. The developer bag 20 includes a bonded portion that may be a portion of the developer bag 20. The developer bag 20 is sealed at the bonded portion to close an outlet for releasing toner T stored therein. The bonded portion is positioned at an end portion of the bag portion 21 to which the connecting portion 22 of the developer bag 20 is connected. The bonded portion is configured to separate from the end portion of the bag portion 21 by contact of the bag portion 21 to a squeeze portion 15.

The winding shaft 11 is rotatably supported by the housing 2. The winding shaft 11 is disposed opposite to the developing roller 3 across the agitator 7. The winding shaft 11 is disposed outside or out of a rotation path K of the agitator 7 within the housing 2. The winding shaft 11 is configured to rotate in a direction to wind the developer bag 20 therearound from below, e.g., in a counterclockwise direction in FIG. 1.

The housing 2 includes a developer storage chamber 12, a waste bag storage portion 13, a handle 14, and the squeeze portion 15. The developer storage chamber 12 accommodates the developer bag 20 therein. The waste bag storage portion 13 is configured to store the developer bag 20 that has wound around the winding shaft 11.

The waste bag storage portion 13 protrudes outwardly relative to the developer storage chamber 12 in the housing 2. The winding shaft 11 is disposed in the waste bag storage portion 13. The waste bag storage portion 13 has a lower wall 13A below the winding shaft 11. The lower wall 13A is downwardly inclined toward the developer storage chamber 12. The lower wall 13A is contiguous to inner wall surfaces defining the developer storage chamber 12 of the housing 2. The entire portion of the lower wall 13A is downwardly inclined toward the developer storage chamber 12. The waste bag storage portion 13 has a relatively wide open entrance and is tapered toward the back from the entrance when viewed in a direction in which a rotation axis of the winding shaft 11 extends (i.e., the height of the waste bag storage portion 13 decreases gradually toward the back in FIG. 1). That is, the entrance of the waste bag storage portion 13 has the largest height. A lower end of the lower wall 13A is spaced from the squeeze portion 15.

The handle 14 extends from an outer surface of the housing 2 and is a one piece with the housing 2. The handle 14 is disposed near the winding shaft 11 rather than the developing roller 3.

The squeeze portion 15 includes a first portion 15A, and a second portion 15B that is spaced from the first portion 15A by a predetermined distance. The squeeze portion 15 is disposed between the waste bag storage portion 13 and the bag portion 21 of the developer bag 20 that has not been wound around the winding shaft 11. In the illustrative embodiment, for example, the squeeze portion 15 is positioned at the entrance of the waste bag storage portion 13. A clearance between the first portion 15A and the second portion 15B, i.e., a height of an opening of the squeeze portion 15, is smaller than a maximum height of the waste bag storage portion 13 in a direction in which the first portion 15A and the second portion 15B face each other. The clearance between the first portion 15A and the second portion 15B is greater than a thickness of the developer bag 20 that has released toner T completely therefrom. For example, the clearance between the first portion 15A and the second portion 15B may be equal to a thickness of a sheet member for the developer bag 20 plus 3 mm or less, preferably 2 mm or less, more preferably 1 mm or less.

The first portion 15A protrudes from an inner surface of an upper wall 2A of the housing 2. The first portion 15A has a substantially rectangular shape when viewed in the axial direction of the winding shaft 11. The second portion 15B is a one piece with the housing 2. The second portion 15B has a substantially triangular shape when viewed in the axial direction of the winding shaft 11. The second portion 15B has corners, one of which is an acute corner 15C situated on a farther side from the winding shaft 11 in a direction in which the squeeze portion 15 and the winding shaft 11 face each other. The connecting portion 22 of the developer bag 20 is connected to the winding shaft 11 while being positioned between the first portion 15A and the second portion 15B. In this state, the connecting portion 22 connects between the bag portion 21 and the winding shaft 11.

The agitator 7 may be a deformable sheet-shaped member. The agitator 7 is rotatably supported by the housing 2.

Figure 2:
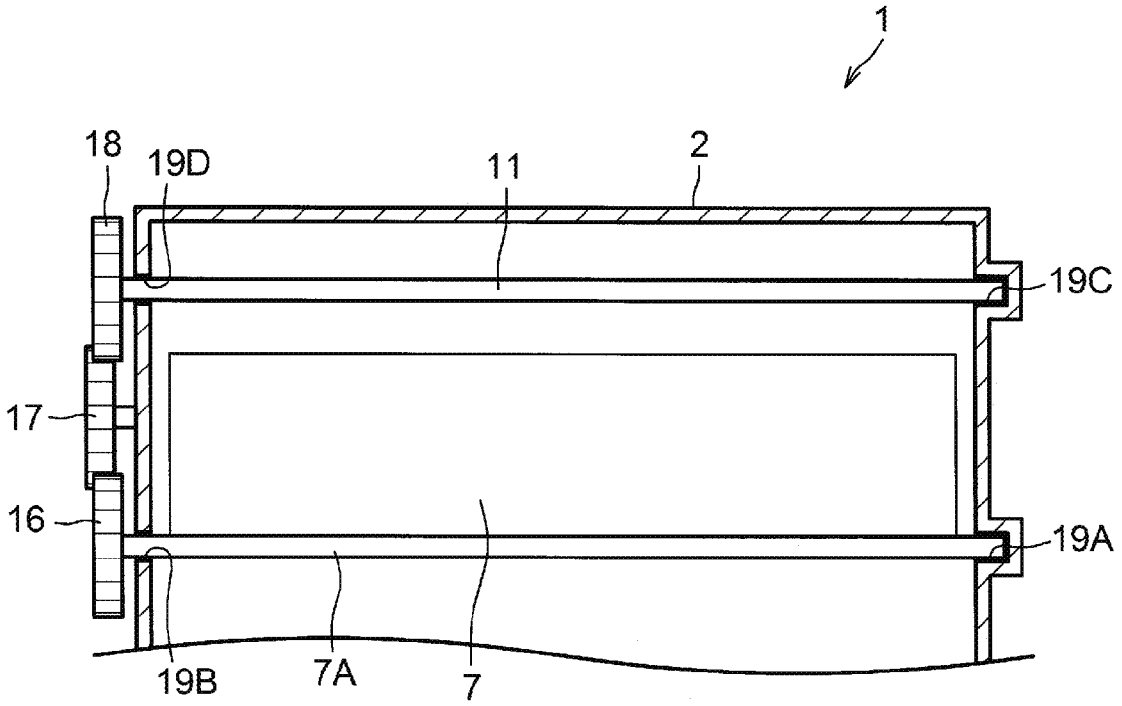
FIG. 2 is a vertical sectional view illustrating the developing cartridge in the illustrative embodiment according to one or more aspects of the disclosure.

As illustrated in FIG. 2, the agitator 7 is rotatably supported by the housing 2 via a rotating shaft 7A. The rotating shaft 7A has one end portion that is rotatably supported by a first bearing 19A that may be a recess defined by inner wall surfaces of the housing 2. The rotating shaft 7A has the other end portion that is rotatably supported by a second bearing 19B of the housing 2. The other end portion of the rotating shaft 7A extends to the outside of the housing 2. A first gear 16 is fixed to the exposed end of the rotating shaft 7A. The first gear 16 is configured to transmit a driving force to the rotating shaft 7A from a motor (not illustrated) as a drive source. The first gear 16 is in mesh with a second gear 17 rotatably supported by the housing 2.

The winding shaft 11 extends in a direction along a direction in which a rotation axis of the agitator 7 extends. The winding shaft 11 has one end portion that is rotatably supported by a third bearing 19C that may be a recess defined by inner wall surfaces of the housing 2. The winding shaft 11 has the other end portion that is rotatably supported by a fourth bearing 19D of the housing 2. The other end portion of the winding shaft 11 extends to the outside of the housing 2. A third gear 18 is fixed to the exposed end of the winding shaft 11. The third gear 18 is in mesh with the second gear 17. The third gear 18 is configured to transmit a driving force received from the drive source via the first gear 16 and the second gear 17 to the winding shaft 11.

Figure 3A:
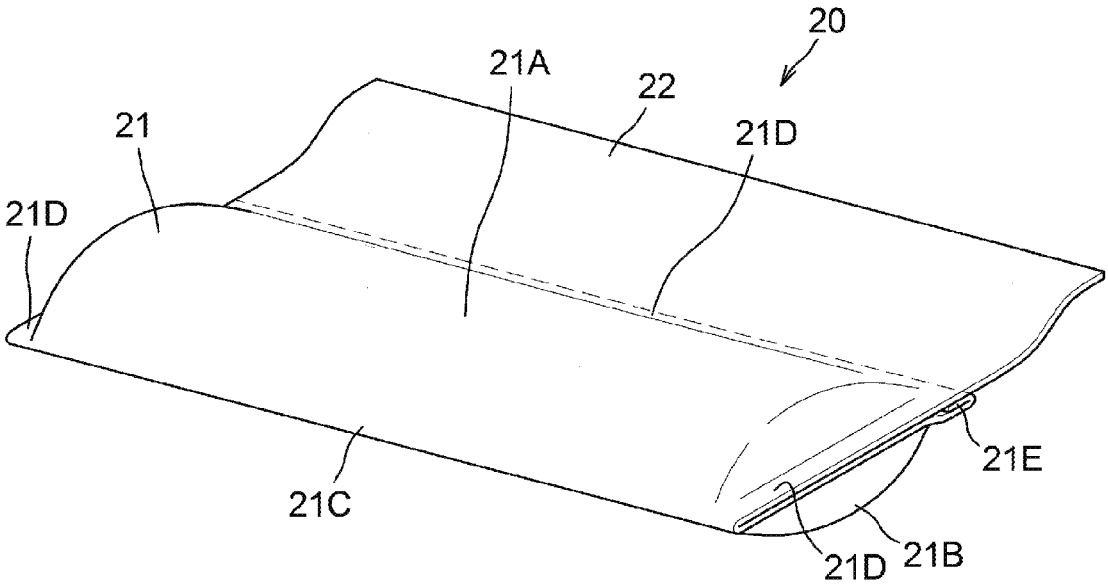
FIG. 3A is an external perspective view illustrating a developer bag in the illustrative embodiment according to one or more aspects of the disclosure.

As illustrated in FIG. 3A, the developer bag 20 including the bag portion 21 and the connecting portion 22 is formed by a folded sheet member. The sheet member is folded to make a crease 21C, and edge portions of the overlapping portions are bonded to each other using an adhesive B. By doing so, such a developer bag 20 may be formed. The bag portion 21 includes an upper portion 21A and a lower portion 21B that are contiguous to each other via the crease 21C. The upper portion 21A is bonded to the lower portion 21B at three sides (e.g., edge portions 21D) other than the crease 21C.

Figure 3B:
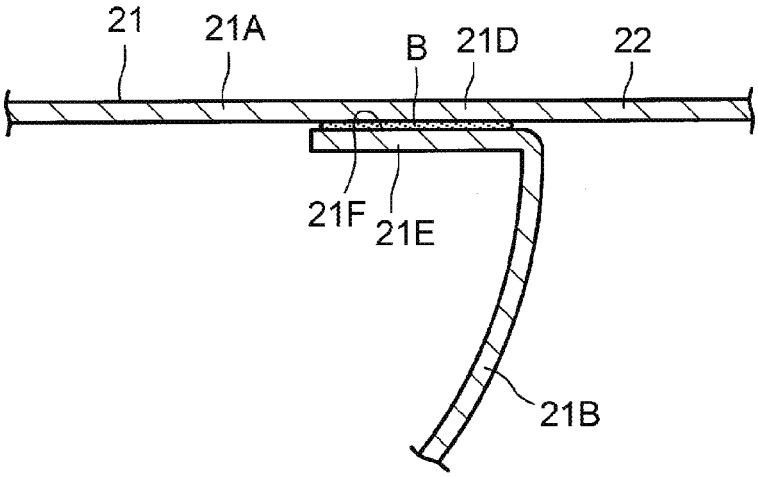
FIG. 3B is a sectional view illustrating a portion of the developer bag where an upper portion and a lower portion are bonded to each other in the illustrative embodiment according to one or more aspects of the disclosure.

As illustrated in FIG. 3B, an end portion 21E of the lower portion 21B situated close to the connecting portion 22 is folded back toward the inside of the bag portion 21. The end portion 21E has a surface 21F (e.g., an upper surface in FIG. 3B) that extends contiguously from an external surface of the lower portion 21B. The surface 21F of the end portion 21E is bonded to a lower surface of the upper portion 21A by an adhesive B. The portion (e.g., the surface 21F) of the end portion 21E bonded to the upper portion 21A using the adhesive B may be a bonded portion where a portion of the developer bag 20 is bonded to another portion of the developer bag 20 to close the outlet for releasing toner T stored in the developer bag 20 therefrom. The bonded portion is positioned at the end portion of the bag portion 21 where the connection portion 22 is connected to. The bonded portion is configured to separate from the lower surface of the upper portion 21A by contact of the bag portion 21 and the squeeze portion 15.

The sheet member used for the developer bag 20 may be made of metallic materials, e.g., aluminum, or resin materials, e.g., polyethylene terephthalate ("PET"), polyethylene ("PE"), or polypropylene ("PP).

Hereinafter, an explanation will be made on how the developing cartridge 1 operates when it is used in an image forming apparatus.

Figure 4A:
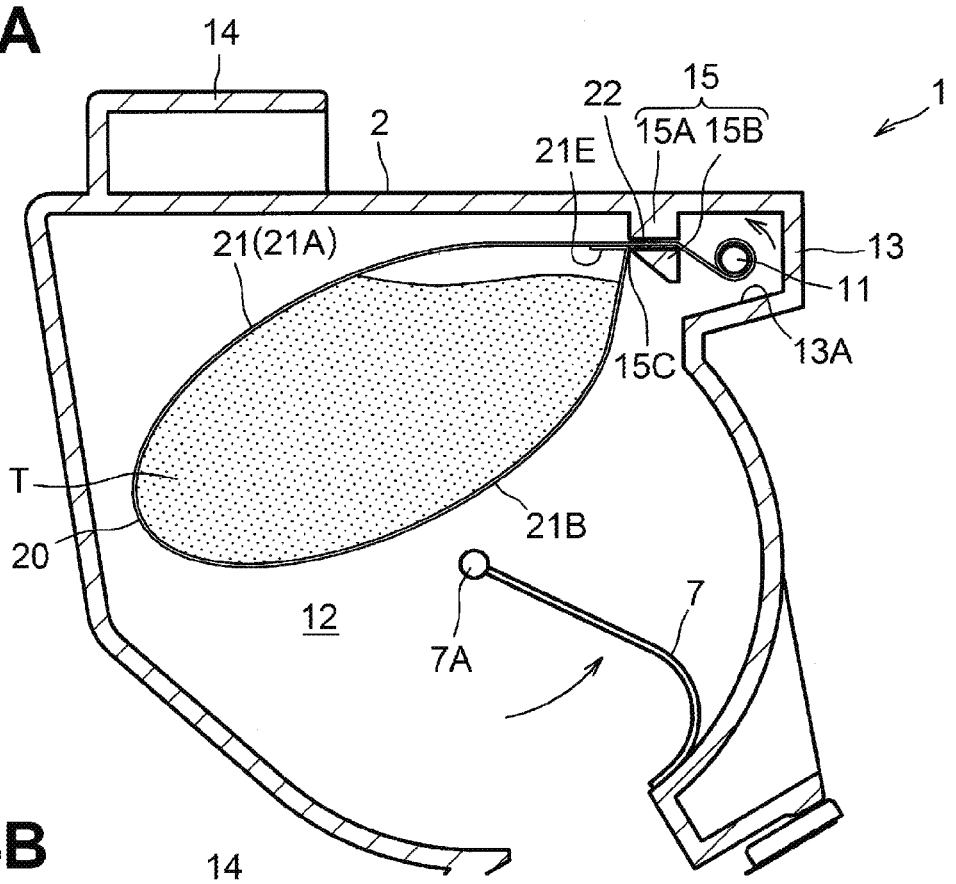
FIG. 4A illustrates how the developer bag is opened in the illustrative embodiment according to one or more aspects of the disclosure.

As illustrated in FIG. 4A, in response to rotation of the agitator 7 by a driving force from the drive source, the winding shaft 11 rotates counterclockwise in synchronization with the rotation of the agitator 7. As the winding shaft 11 starts rotating, the connecting portion 22 fixed to the winding shaft 11 is wound around the winding shaft 11 from below. Thus, the bag portion 21 is pulled toward the winding shaft 11 to contact the squeeze portion 15. At that time, the corner 15C of the second portion 15B strongly contacts the vicinity of the end portion 21E of the bag portion 21 to remove the end portion 21E from the upper portion 21A downward. Thus, in the developer bag 20, the bonded portion separates from the upper portion 21A and therefore the outlet (as an example of an opening) for releasing toner T from the developer bag 20 to the developer storage chamber 12 appears.

Figure 4B:
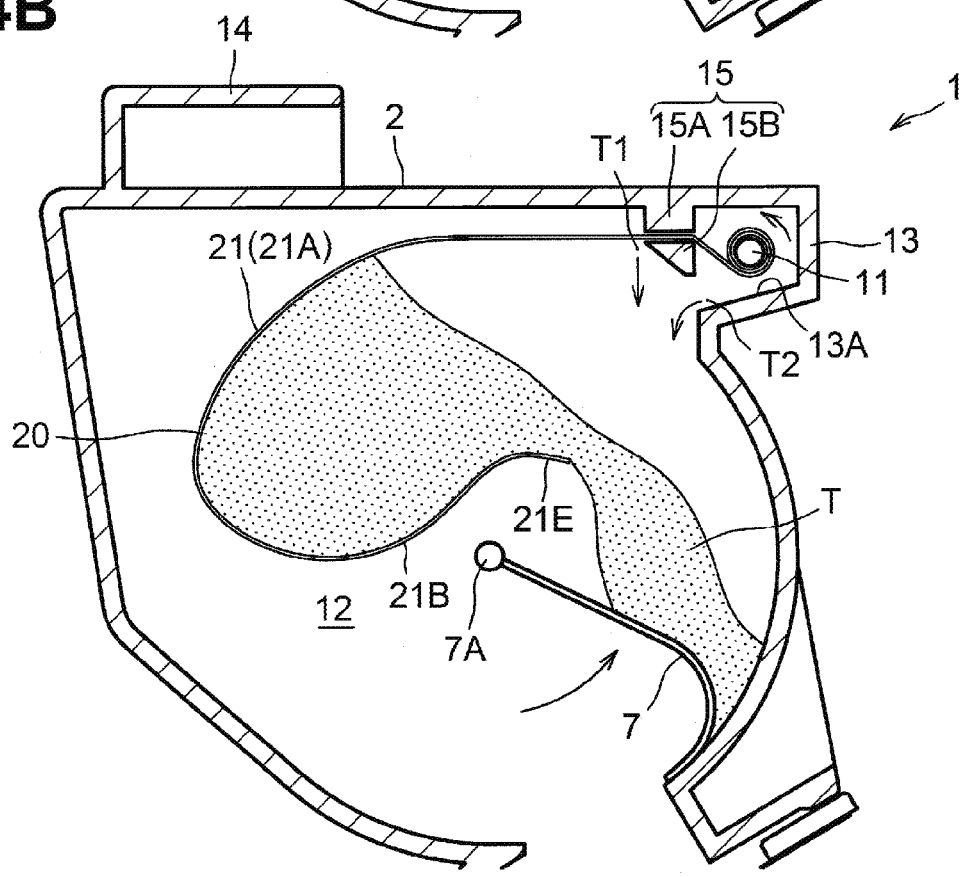
FIG. 4B illustrates how a developer is released from the opened developer bag in the illustrative embodiment according to one or more aspects of the disclosure.

As illustrated in FIG. 4B, as the winding shaft 11 further rotates counterclockwise, the winding shaft 11 rolls up the connecting portion 22 and the bag portion 21, and the squeeze portion 15 squeezes toner T from the bag portion 21. At that time, the bag portion 21 widely opens by separation of the lower portion 21B from the upper portion 21A by weight of toner T. Thus, toner T is allowed to flow to the developer storage chamber 12 from the bag portion 21.

When the winding shaft 11 further rotates counterclockwise, toner T1 adhering to the interior surface of the bag portion 21 is scraped by the squeeze portion 15. As the lower portion 21B separates from the upper portion 21A completely, the developer bag 20 returns to a sheet member. An entire portion of the developer bag 20 is then wound around the winding shaft 11 and removed from the developer storage chamber 12. The developer bag 20 wound around the winding shaft 11 is compactly stored in the waste bag storage portion 13 in a rolled manner. After the developer bag 20 has completely wound, the rotation of the winding shaft 11 may be stopped by disengagement of the second gear 17 and the third gear 18.

Toner T released to the developer storage chamber 12 is supplied to the supply roller 4. The supply roller 4 then supplies toner T to the developing roller 3 by rotating in contact with the developing roller 3. The layer-thickness regulating blade 5 regulates a layer thickness of toner T held by the developing roller 3. Thereafter, toner T is supplied onto a circumferential surface of the photosensitive drum 6.

While the developing cartridge 1 is in operation, some (T2) of toner T may intrude into the waste bag storage portion 13. Nevertheless, the intruding toner T2 slides down the inclined lower wall 13A to return to the developer storage chamber 12.

According to the illustrative embodiment, the following effects may be obtained.

The sealed developer bag 20 is opened by first rotation of the winding shaft 11 disposed in the housing 2. Therefore, the developer bag 20 may be sealed to store toner T therein until first use of the developing cartridge 1. That is, toner T may be released from the developer bag 20 at the first use of the developing cartridge 1. Thus, this configuration may eliminate a user's operation for opening the developer bag 20 when the developing cartridge 1 is first used, and may also reduce or prevent leakage of toner T to the outside of the housing 2. In addition, toner T is stored in the sealed developer bag 20 until immediately before the developing cartridge 1 is first used, which may reduce deterioration of toner T. Therefore, toner T may have a long use life.

While the developer bag 20 passes through the narrow clearance (e.g., the narrow opening) in the squeeze portion 15, toner T may be squeezed out from the developer bag 20. While the developer bag 20 passes therethrough, toner T adhering to the interior surface of the developer bag 20 may also be scraped therefrom. Therefore, this configuration may minimize residual toner T on the interior surface of the developer bag 20. Providing the squeeze portion 15 at the entrance of the waste bag storage portion 13 may enable the rolled developer bag 20 to be kept in the waste bag storage portion 13 without allowing the developer bag 20 to return to the developer storage chamber 12.

The winding shaft 11 is disposed outside or out of the rotation path K of the agitator 7. Therefore, the winding shaft 11 may fail to interfere with the agitator 7. The developer bag 20 wound around the winding shaft 11 may also fail to interfere with the agitator 7. Therefore, toner T released to and stored in the developer storage chamber 12 may be agitated by the agitator 7 and supplied to the developing roller 3 by the agitator 7 effectively.

The winding shaft 11 is disposed opposite to the developing roller 3 across the agitator 7. With this configuration, the developer bag 20 wound around the winding shaft 11 may fail to interfere with the developing roller 3 and the supply roller 4 adjacent to the developing roller 3. Therefore, toner T released to and stored in the developer storage chamber 12 may be supplied to the developing roller 3 effectively.

The waste bag storage portion 13 protrudes outwardly relative to the developer storage chamber 12 in the housing 2. With this configuration, the rolled developer bag 20 stored in the waste bag storage portion 13 may fail to interfere with operation by the agitator 7, such as agitation of toner T by the agitator 7 or supply of toner T to the developing roller 3 by the agitator 7.

The developer bag 20 returns to the sheet member after completely releasing toner T therefrom. Therefore, the winding shaft 11 may roll up the developer bag 20 compactly, and toner T remaining on the interior surface of the developer bag 20 may be reduced to a minimum. In addition, toner T adhering the interior surface of the developer bag 20 (e.g., the sheet member) may be scraped therefrom by the squeeze portion 15.

The developer bag 20 is wound around the winding shaft 11 from below. With this configuration, when the winding shaft 11 rolls up the developer bag 20 therearound, toner T may be removed from the lower surface (e.g., the interior surface) of the upper portion 21A of the bag portion 21 at the squeeze portion 15. Thus, the developer bag 20 may be wound with minimum toner T remaining thereto.

When the developer bag 20 is being opened, the end portion 21E of the lower portion 21B is gradually peeled from the upper portion 21A, which may enable a force of pulling the developer bag 20 to be smaller. Therefore, this configuration may further enable a driving force of the drive source to be smaller.

The handle 14 is disposed near the winding shaft 11 rather than the developing roller 3. Therefore, when the user attaches or detaches the developing cartridge 1 to or from the image forming apparatus by holding the handle 14, this configuration may eliminate an accidental touch to the developing roller 3 by the user.

While the disclosure has been described in detail with reference to the specific embodiment thereof, this is merely an example, and various changes, arrangements and modifications may be applied therein without departing from the spirit and scope of the disclosure. Hereinafter, the disclosure will be further described with reference to alternative embodiments. An explanation will be given mainly for the parts different from the illustrative embodiment, and an explanation will be omitted for the common components by assigning the same reference numerals thereto.

First Alternative Embodiment

In the illustrative embodiment, the waste bag storage portion 13 protrudes horizontally relative to the developer storage chamber 12 in the housing 2. Nevertheless, in other embodiments, for example, a bag storage portion may protrude vertically (e.g., upward) relative to the developer storage chamber in the housing.

Figure 5:
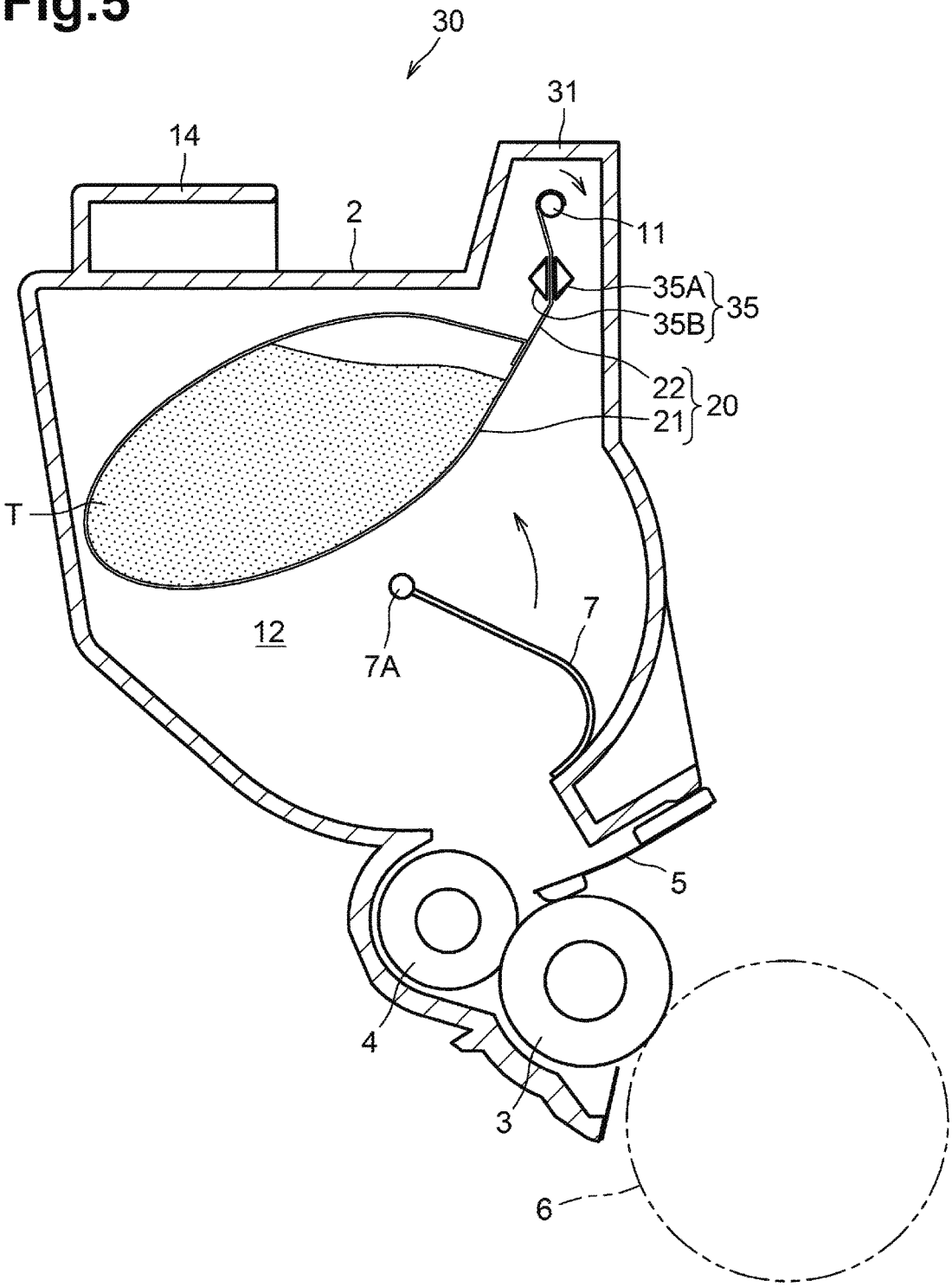
FIG. 5 illustrates a developing cartridge in a first alternative embodiment according to one or more aspects of the disclosure.

As illustrated in FIG. 5, in a first alternative embodiment, for example, a developing cartridge 30 includes a bag storage portion 31 protruding upward relative to the developer storage chamber 12 in the housing 2. The winding shaft 11 is disposed in the upwardly-protruding waste bag storage portion 31. A squeeze portion 35 including a first portion 35A and a second portion 35B is disposed below the winding shaft 11. The first portion 35A and the second portion 35B each have a triangular shape when viewed in direction in which the rotation axis of the winding shaft 11 extends. The first portion 35A and the second portion 35B each have an inclined upper surface. The waste bag storage portion 31 has no partition (e.g., a lower wall) for dividing the waste bag storage portion 31 and the developer storage chamber 12.

According to the first alternative embodiment, this configuration may also enable release of toner T from the developer bag 20 within the developing cartridge 30 and storage of the rolled developer bag 20 in the waste bag storage portion 31. According to the first alternative embodiment, the waste bag storage portion 31 protrudes upward and has no lower wall. Therefore, toner T intruding the waste bag storage portion 31 may fall down to return to the developer storage chamber 12. Further, each of the first portion 35A and the second portion 35B of the squeeze portion 35 has the inclined upper surface. This configuration may reduce accumulation of toner T falling on the first portion 35A and the second portion 35B from the waste bag storage portion 31.

Second Alternative Embodiment

In the illustrative embodiment, the developer bag 20 is opened by peeling off the bonded portion bonded using the adhesive B. Nevertheless, in other embodiments, for example, a developer bag may have an easy-to-tear portion at which the developer bag may tear easily as compared with the other portions thereof.

Figure 6:
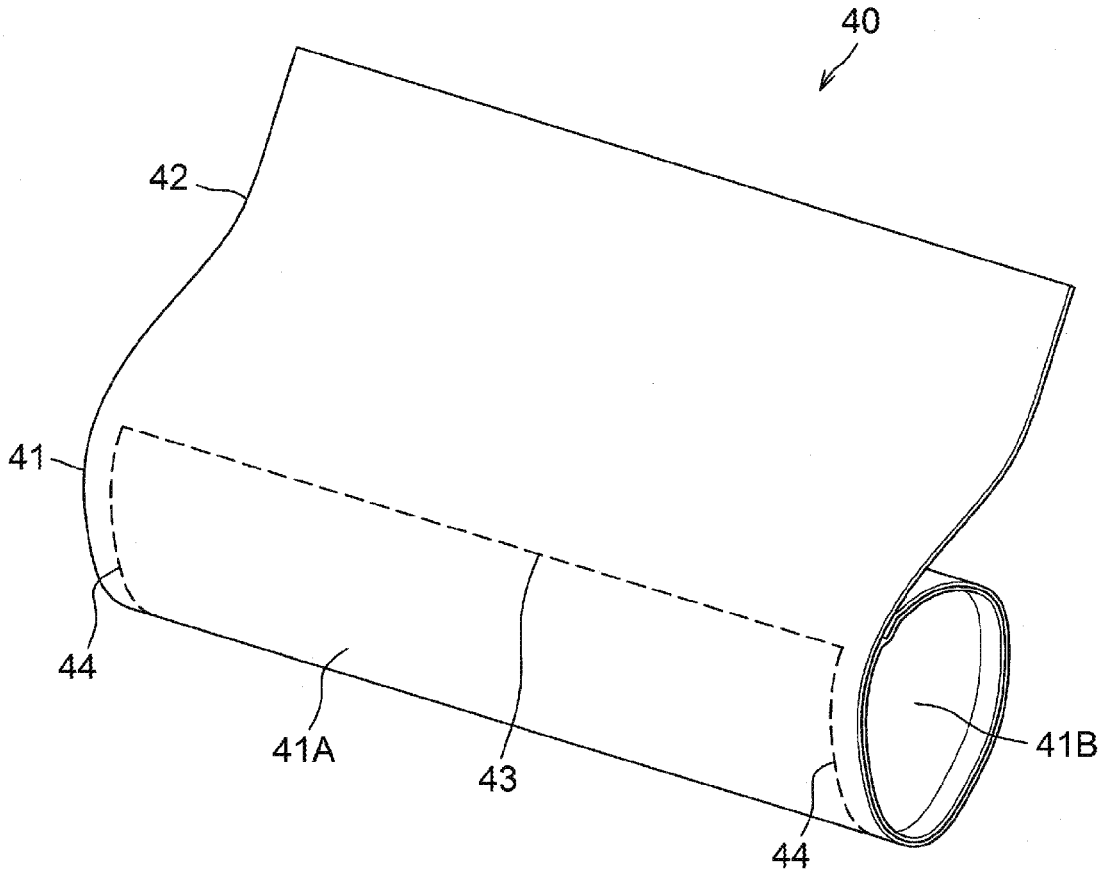
FIG. 6 illustrates a developer bag in a second alternative embodiment according to one or more aspects of the disclosure.

As illustrated in FIG. 6, in a second alternative embodiment, for example, a developer bag 40 includes a bag portion 41 storing toner T therein, and a connecting portion 42 connecting between the winding shaft 11 and the bag portion 41. The bag portion 41 includes a cylindrical portion 41A and side portions 41B. The side portions 41B close ends of the cylindrical portion 41A. The bag portion 41 has first perforations 43 and second perforations 44, which are an example of the easy-to-tear portion. The first perforations 43 align along an end portion of the bag portion 41 where the connecting portion 42 is connected to. The second perforations 44 extend from each end of the line of the first perforations 43 and align along a circumferential direction of the cylindrical portion 41A.

According to the second alternative embodiment, this configuration may also enable the bag portion 41 to be opened to release toner T therefrom in response to winding of the developer bag 40 around the winding shaft 11 (not illustrated in FIG. 6). More specifically, the bag portion 41 is torn at the first perforations 43 to release toner T therefrom by contact of the first perforations 43 to the squeeze portion 15 in response to winding of the developer bag 40 around the winding shaft 11.

Third Alternative Embodiment

In the illustrative embodiment, the squeeze portion 15 opens the developer bag 20 by removing a portion (e.g., the bonded portion) of the developer bag 20 from another portion thereof. Nevertheless, in other embodiments, for example, a developer bag may have an outlet for releasing a developer and a developing cartridge may further include a seal member for closing the outlet. In this configuration, the developer bag may be opened by removing the seal member from the outlet.

Figure 7A:
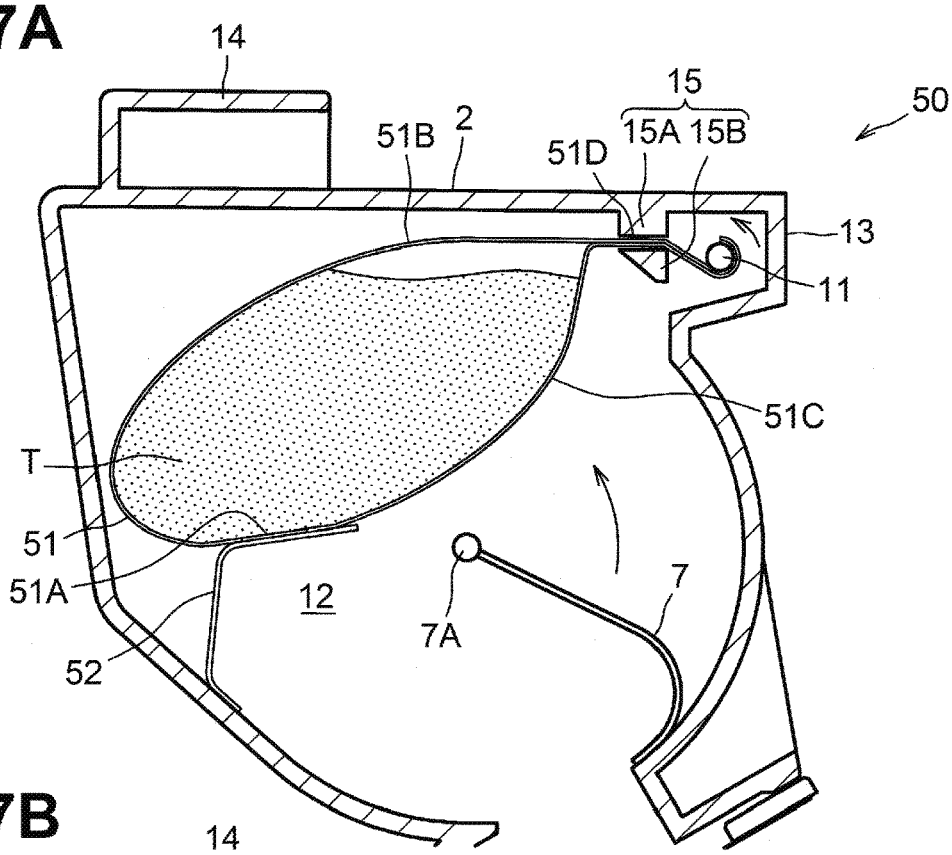
FIG. 7A illustrates a developing cartridge in a third alternative embodiment according to one or more aspects of the disclosure.

As illustrated in FIG. 7A, in a third alternative embodiment, for example, a developing cartridge 50 includes a developer bag 51 having an outlet 51A, a seal member 52, and the squeeze portion 15. The seal member 52 has one end portion that closes the outlet 51A to seal the developer bag 51, and the other end portion that is fixed to one of the inner surfaces of the housing 2 of the developing cartridge 50. The adhesive strength of the other end portion to the inner surface of the housing 2 is stronger than the adhesive strength of the one end portion to the developer bag 51.

Figure 7B:
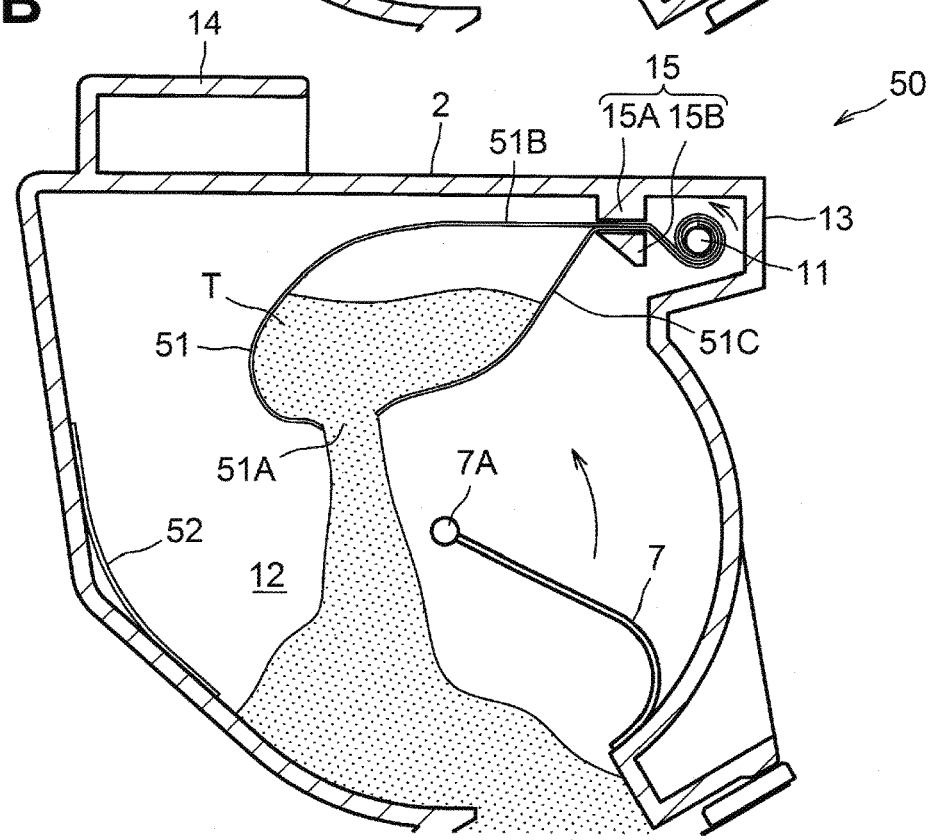
FIG. 7B illustrates how a developer is released from an opened developer bag in the third alternative embodiment according to one or more aspects of the disclosure.

As illustrated in FIG. 7B, as the winding shaft 11 rotates, the winding shaft 11 pulls the developer bag 51 to remove the seal member 52 from the developer bag 51 to reveal the outlet 51A. In response to removal of the seal member 52, the outlet 51A becomes exposed and thus toner T is released to the developer storage chamber 12. The developer bag 51 is wound around the winding shaft 11 while an upper portion 51B and a lower portion 51C of the developer bag 51 pass between the first portion 15A and the second portion 15B of the squeeze portion 15 simultaneously. Thus, the developer bag 51 is squeezed by the squeeze portion 15 to release toner T therefrom. According to the third alternative embodiment, this configuration may also enable the bag portion 51 to be opened to release toner T therefrom by rotation of the winding shaft 11. In this configuration, the developer bag 51 that has released toner T therefrom completely is also wound around the winding shaft 11. Therefore, the waste developer bag 51 may fail to interfere with operation by the agitator 7, such as agitation of toner T by the agitator 7 or supply of toner T to the developing roller 3 by the agitator 7.

Fourth Alternative Embodiment

In the illustrative embodiment, the winding shaft 11 extends along the direction in which the rotating shaft 7A of the agitator 7 extends. Nevertheless, in other embodiments, for example, a winding shaft may extend in a direction orthogonal to the direction in which the rotating shaft of the agitator extends.

Figure 8:
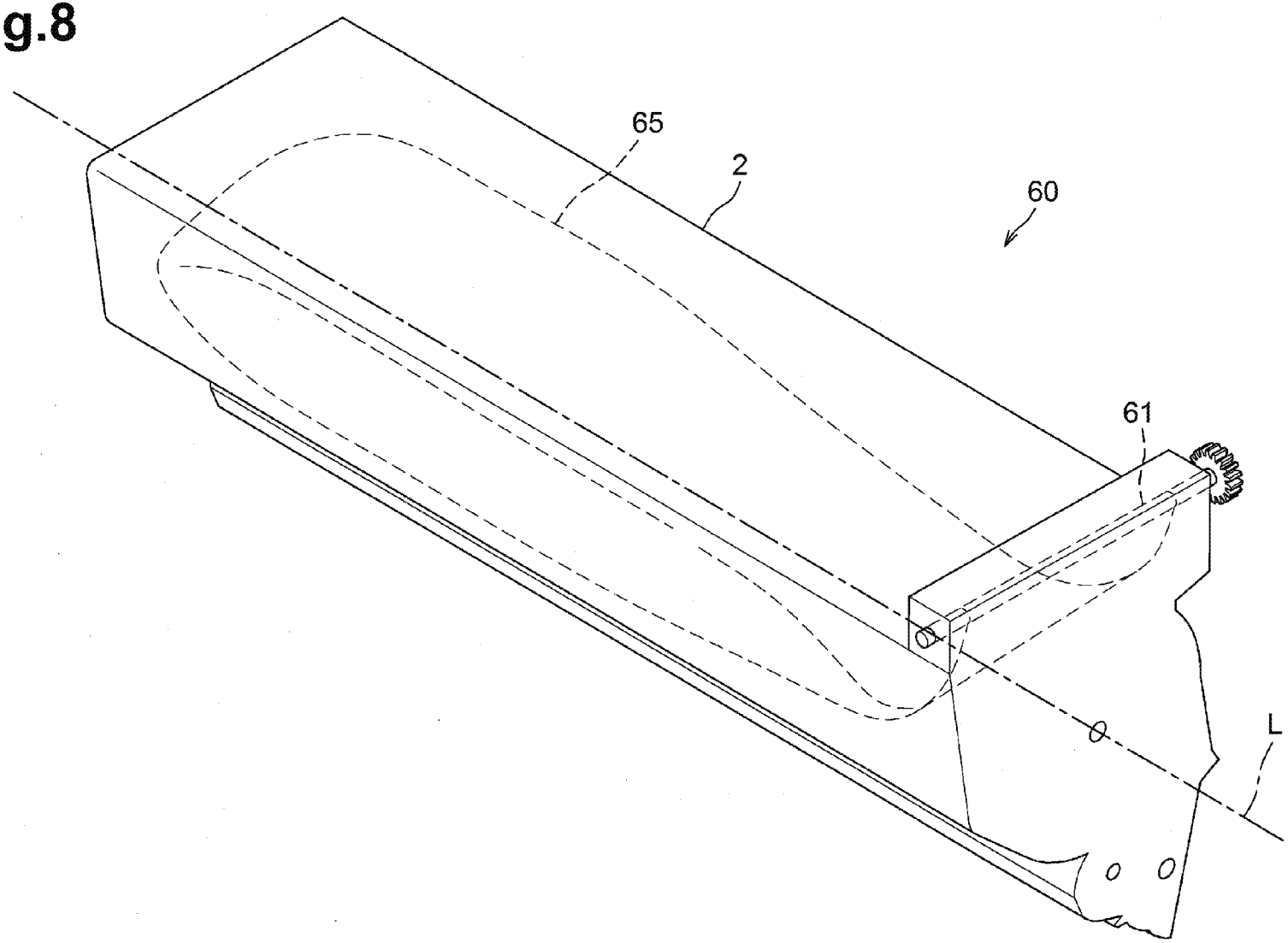
FIG. 8 illustrates a developing cartridge in a fourth alternative embodiment according to one or more aspects of the disclosure.

As illustrated in FIG. 8, in a fourth alternative embodiment, for example, a developing cartridge 60 includes a winding shaft 61 that extends in a direction orthogonal to a rotating axis L of the agitator 7. The developer bag 65 is connected to the winding shaft 61. According to the fourth alternative embodiment, this configuration may also enable the winding shaft 61 to roll up the developer bag 65 that has released toner T therefrom completely. Therefore, the rolled developer bag 65 may fail to interfere with operation of the developing cartridge 60.

Fifth Alternative Embodiment

In the illustrative embodiment, the squeeze portion 15 has the opening (e.g., the clearance between the first portion 15A and the second portion 15B) therein. Nevertheless, in other embodiments, for example, a squeeze portion may be configured to pinch a developer bag.

Figure 9A:
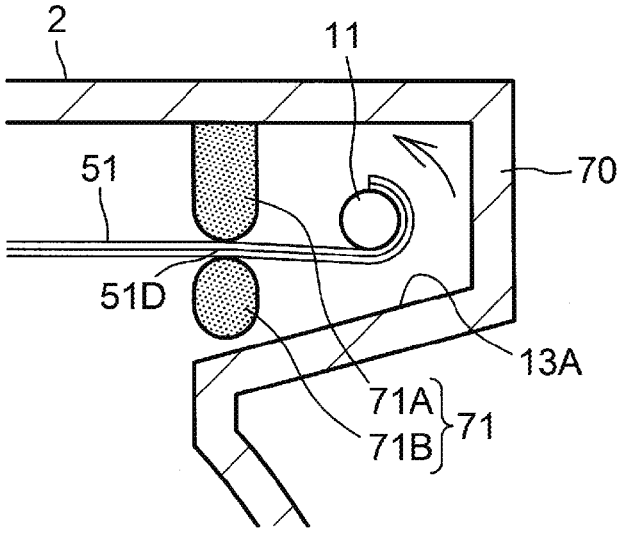
FIG. 9A is an enlarged view illustrating a waste bag storage portion and its surrounding components in a fifth alternative embodiment according to one or more aspects of the disclosure.

As illustrated in FIG. 9A, in a fifth alternative embodiment, for example, a waste bag storage portion 70 includes a squeeze portion 71 at its entrance. The squeeze portion 71 may be made of sponge. The waste bag storage portion 70 is configured to pinch a connecting portion 51D of the developer bag 51. The squeeze portion 71 includes a first portion 71A and a second portion 71B, each of which is fixed to the housing 2. The first portion 71A and the second portion 71B pinch the developer bag 51 therebetween. Therefore, in response to rolling up of the connecting portion 51D by the winding shaft 11, toner T remaining in the developer bag 51 is squeezed therefrom by elastic force of the sponges. According to the fifth alternative embodiment, this configuration may therefore minimize residual toner T in the developer bag 51.

Sixth Alternative Embodiment

Figure 9B:
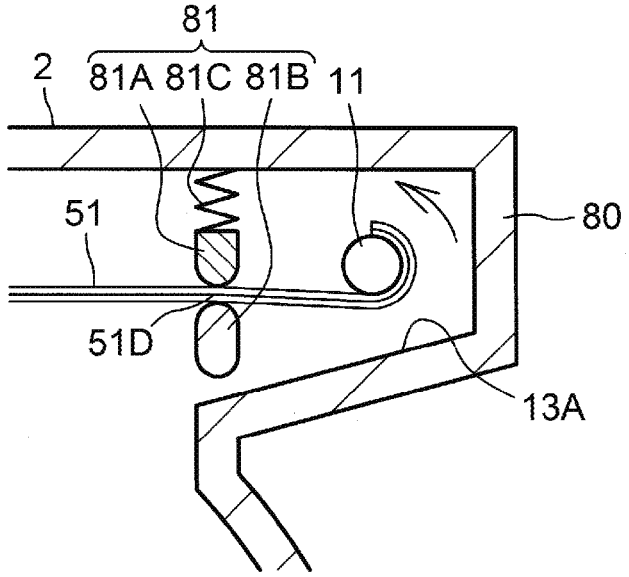
FIG. 9B is an enlarged view illustrating a waste bag storage portion and its surrounding components in a sixth alternative embodiment according to one or more aspects of the disclosure.

In other embodiments, for example, a squeeze portion may pinch the connecting portion 51D using an urging member. As illustrated in FIG. 9B, in a six alternative embodiment, for example, a squeeze portion 81 is disposed at an entrance of a waste bag storage portion 80 and includes a first portion 81A, a second portion 81B, and an urging member 81C. The first portion 81A is supported by the housing 2 and is configured to move in a direction in which the first portion 81A moves closer to and away from the second portion 81B. The urging member 81C urges the first portion 81A toward the second portion 81B. The second portion 81B is fixedly supported by the housing 2. According to the sixth alternative embodiment, the first portion 81A is urged toward the second portion 81B. Thus, the first portion 81A and the second portion 81B pinch the developer bag 51 therebetween. Therefore, this configuration may also enable remaining toner T to be squeezed out of the developer bag 51, and minimize residual toner T on the interior surface of the developer bag 51 (also refer to FIG. 7).

Seventh Alternative Embodiment

Figure 9C:
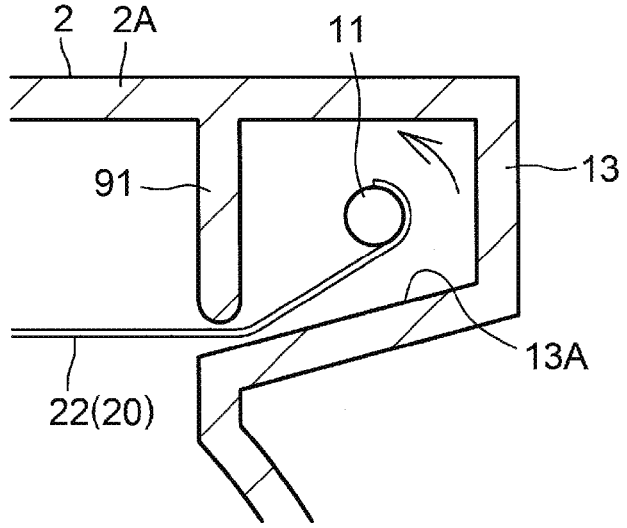
FIG. 9C is an enlarged view illustrating a waste bag storage portion and its surrounding components in a seventh alternative embodiment according to one or more aspects of the disclosure.

In the illustrative embodiment, the squeeze portion 15 includes the first portion 15A and the second portion 15B that is spaced from the upper wall 2 of the housing 2. Nevertheless, the configuration of the squeeze portion might not be limited to the specific example. As illustrated in FIG. 9C, in a seventh alternative embodiment, for example, a squeeze portion 91 includes a protruding wall and the lower wall 13A of the waste bag storage portion 13. The protruding wall extends from the upper wall 2A of the housing 2 toward the lower wall 13A of the waste bag storage portion 13. A distal end of the protruding wall of the squeeze portion 91 is spaced from the lower wall 13A by a predetermined distance. The connecting portion 22 of the developer bag 20 is connected to the winding shaft 11 through between the protruding wall of the squeeze portion 91 and the lower wall 13A. According to the seventh alternative embodiment, this configuration may also enable remaining toner T to be squeezed out of the developer bag 20, and minimize residual toner T on the interior surface of the developer bag 20 (also refer to FIG. 1).

In the illustrative embodiment, the winding shaft 11 is driven by the motor. Nevertheless, in other embodiments, for example, the winding shaft may be rotated manually.

In the illustrative embodiment, the developer bag 20 consists of a single sheet member. Nevertheless, in other embodiments, for example, a developer bag may consist of a plurality of sheet members, e.g., two or more sheet members.

What is claimed is:

1. A developing cartridge comprising:

a developing roller;

a developer bag storing a developer therein;

a housing including a developer storage chamber accommodating the developer bag therein, the housing supporting the developing roller;

an agitator disposed in the housing, and configured to rotate to agitate the developer stored in the housing; and a shaft fixed to the developer bag and movable to pull the developer bag theretoward, wherein the shaft extends along a rotating axis of the agitator.

2. The developing cartridge according to claim 1, wherein the shaft is movable to form an opening on the developer bag, and then is configured to remove the developer bag, on which the opening is formed, from the developer storage chamber.

3. The developing cartridge according to claim 2, wherein the shaft is rotatable to wind the developer bag around the shaft.

4. The developing cartridge according to claim 1, wherein the shaft is disposed outside of a rotation path of the agitator.

5. The developing cartridge according to claim 1, wherein the shaft is disposed opposite to the developing roller across the agitator.

6. The developing cartridge according to claim 1, wherein the shaft is disposed inside the housing.

7. The developing cartridge according to claim 3, wherein the housing further includes a waste bag storage portion configured to store the wound developer bag, and wherein the waste bag storage portion protrudes outwardly relative to the developer storage chamber.

8. The developing cartridge according to claim 7, wherein the developer bag includes:

a bag portion configured to store the developer therein; and a connecting portion having one end connected to the bag portion, and another end connected to the shaft.

9. The developing cartridge according to claim 8, further comprising a squeeze portion disposed between the waste bag storage portion and the bag portion that has not been wound around the shaft, wherein the squeeze portion has an opening whose height is smaller than a height of the waste bag storage portion when viewed in a direction in which a rotating axis of the shaft extends.

10. The developing cartridge according to claim 9, wherein the squeeze portion pinches the connecting portion.

11. The developing cartridge according to claim 9, wherein the squeeze portion is made of sponge.

12. The developing cartridge according to claim 8, wherein the bag portion has an easy-to-tear portion extending along a portion thereof to which the connecting portion is connected, wherein the easy-to-tear portion is configured to tear easily as compared with all other portions of the bag portion.

13. The developing cartridge according to claim 1, further comprising a gear configured to transmit a driving force from a drive source to the shaft.

14. The developing cartridge according to claim 7, wherein the waste bag storage portion includes a lower wall disposed below the shaft, and wherein the lower wall is inclined downward toward the developer storage chamber.

15. The developing cartridge according to claim 9, wherein the developer bag includes a bonded portion that is a portion of the developer bag bonded to another portion of the developer bag to close an outlet for releasing the developer stored therein, and wherein the bonded portion is positioned at an end portion of the developer bag to which the connecting portion is connected, and is configured to separate from the another portion of the developer bag by contact of the bag portion to the squeeze portion.

16. The developing cartridge according to claim 1, wherein the developer bag includes metal.

17. The developing cartridge according to claim 1, wherein the developer bag includes resin.

18. A developing cartridge comprising:

a developing roller;

a developer bag storing a developer therein;

a shaft fixed to the developer bag and movable to pull the developer bag theretoward; and a housing including a developer storage chamber accommodating the developer bag therein, the housing supporting the developing roller, the housing including a handle disposed closer to the shaft than to the developing roller.

19. A developing cartridge comprising:

a developing roller;

a developer bag storing a developer therein, the developer bag having an outlet for releasing the developer stored therein;

a housing including a developer storage chamber accommodating the developer bag therein, the housing supporting the developing roller;

a shaft fixed to the developer bag and movable to pull the developer bag theretoward; and a seal member having one end portion sealing the outlet of the developer bag, and another end portion fixed to an inner surface of the housing.

* * * * *